United States Patent [19]

Devaud et al.

[11] Patent Number: 4,905,572

[45] Date of Patent: Mar. 6, 1990

[54] HYDRAULIC DIRECTIONAL VALVE FOR AN AIRCRAFT CONTROL

[75] Inventors: Gërard Devaud, Paris; Serge David, Nanterre, both of France

[73] Assignee: S.A.M.M. - Societe D'Applications Des Machines Motrices, Bievres, France

[21] Appl. No.: 862,194

[22] Filed: May 9, 1986

Related U.S. Application Data

[63] Continuation-in-part of Ser. No. 630,617, Jul. 13, 1984, abandoned.

[30] Foreign Application Priority Data

Jul. 13, 1983 [FR] France ..... 83 11714

[51] Int. Cl.[4] ..... F15B 9/08

[52] U.S. Cl. ..... 91/375 R; 137/625.22

[58] Field of Search ..... 91/375 R; 137/625.22

[56] References Cited

U.S. PATENT DOCUMENTS

| | | | |
|---|---|---|---|
| 1,729,173 | 9/1929 | Marfaing | 91/375 RX |
| 2,490,509 | 12/1949 | Carleton | 91/375 RX |
| 2,728,404 | 12/1955 | Peterson | 91/375 RX |
| 3,254,674 | 6/1966 | Leask | 91/375 RX |
| 4,335,745 | 6/1982 | Bouveret et al. | 137/625.22 X |

*Primary Examiner*—Gerald A. Michalsky

*Attorney, Agent, or Firm*—Sughrue, Mion, Zinn, MacPeak & Seas

[57] ABSTRACT

This hydraulic directional valve for an aircraft servo-control, for example for controlling the air brake flaps of the wings of an aircraft, comprises a plug 12 rotatively mounted in a fixed liner 13 disposed in a body 15 and connected to a control device, and an annular sleeve 14 interposed between the plug 12 and the liner 13, ports 19, 23, 26 for the inlet under pressure and the outlet of a hydraulic fluid being provided in the liner 14 and the sleeve 13, and passages being provided on the periphery of the plug 12 for ensuring the circulation of the hydraulic fluid. According to the invention, the sleeve 14 is rotatively mounted in the body 15 and projects outside the body 15 and is connected to rotate with a lateral lever 32 associated with a feedback device constituting a feedback loop which is capable of causing the sleeve 14 to copy automatically the angular position of the plug 12 after the pilot of the aircraft has commanded a rotation of the plug 12.

3 Claims, 6 Drawing Sheets

HYDRAULIC DIRECTIONAL VALVE FOR AN AIRCRAFT CONTROL

This application is a continuation-in-part application of application Ser. No. 630,617 filed July 13, 1984, now abandoned.

The present invention relates to a hydraulic directional valve for a control of an aircraft and in particular the control of the flaps or "spoilers" of the wings of an aircraft which are employed for controlling the turns of the latter or as air brakes when landing.

Servo-controls are known which have three-way hydraulic directional valves connected to an actuator having a differential function, i.e., only a single chamber is supplied by the valve for controlling the flaps of the wings of an aircraft, with feedbacks having electric means and mechanical intermediate means, i.e., having links and pivots between the feedback and the valve, In this way, there is obtained a device which "copies position" and requires, when the valve is not integrated within the actuator, an extremely space-consuming and complicated system of links and intermediate pivot pins for transmitting to the valve the order to copy the position of the feedback after a control actuation of the pilot.

There is also known from the patent No. GB-A-1 119 991 a four-way servo-control valve performing a function of this type and comprising a central plug and a rotor surrounding the plug but whose construction is complicated and space-consuming. Indeed, in this known arrangement, a body in three parts is provided, two end parts and an intermediate ring, the plug and the rotor being disposed concentrically relative to each other in the region of the intermediate ring and extending respectively through one of the end parts of the body by means of two shafts which are therefore disposed on each side of the body.

An object of the invention is to provide a servo-control having a device copying position which does not have a prohibitive overall size and whose construction is simplified relative to the known systems.

The hydraulic directional valve for an aircraft servo-control, such as flaps of air brakes of wings of an aircraft, contemplated by the invention, comprises a body, a liner fixed in the body, a plug rotatively mounted in the liner and having an end portion which projects from a side of the body, a controlled device connected to the end portion of the plug, an annular sleeve interposed between the plug and the liner, ports for the inlet of the hydraulic fluid under pressure and the outlet of the hydraulic fluid provided in the liner and the sleeve, passages provided on a peripheral portion of the plug for ensuring the circulation of the hydraulic fluid from one port to the other of the liner by passing through the ports of the sleeve when the plug rotates.

According to the invention, the sleeve is rotatively mounted in the body and has an end portion which projects from the side of the body from which side projects said end portions of the plug, a feedback device, and a lateral lever connected to the end portion of the sleeve and associated with the feedback device, the feedback device being capable of progressively returning the sleeve, through said lever, to an initial angular position with respect to the plug, after rotation of the plug through a predetermined angle.

According to another feature of the invention, the valve comprises, in a region of said end portion of the plug and said end portion of the sleeve, an interposed element which is connected to rotate with one of the two elements consisting of the plug and sleeve and is provided with sealing means respectively cooperative with the plug and sleeve.

Thus, the sleeve provided by the invention constitutes the end element of a position copying device.

Consequently, this solution avoids the use of corresponding complicated and space-consuming systems of links and pivotal connections, and replaces them with a single directional valve which has a small overall size and is simple to construct.

Further features and advantages of the invention will be apparent from the following description with reference to the accompanying drawings which illustrate one embodiment of the invention by way of a non-limiting example:

Figure 1:
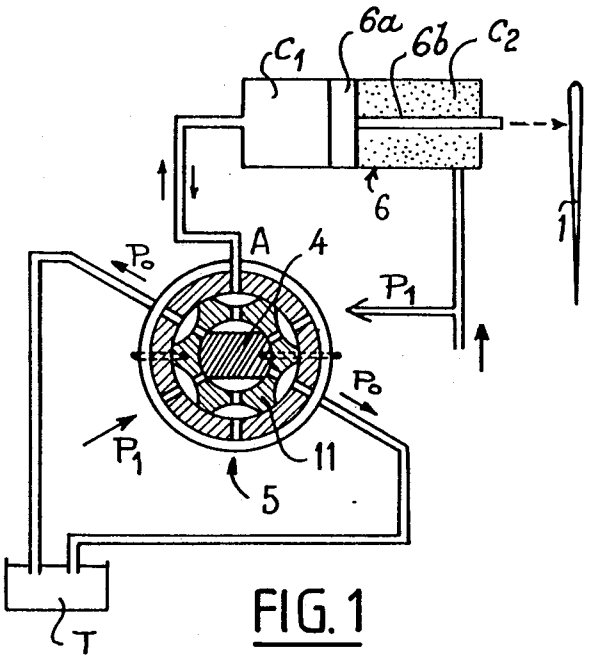
FIG. 1 is a diagrammatic view illustrating the principle of the position-copying servo-control device incorporating a valve according to the invention.

The device diagrammatically shown on FIG. 1 is a hydraulic servo-control system of an element 1 (see also, FIG. 8) which is pivotally mounted on an axel 2 and which may be for example, a flap or "spoiler" of an aircraft wing.

This servo-control device comprises a hydraulic directional valve 5 provided with a rotatably mounted central plug 4 and which is connected to a hydraulic actuator 6 containing a piston **6*a* dividing the actuator in two working chambers C1 and C2. The piston 6*a* has a rod 6*b* whose movement can drive in rotation the axis 2 and flap 1 in a manner illustrated on FIG. 8** and which will be described later.

The chamber C1 is connected to the valve 5 by a conduit A and is filled with a hydraulic fluid at a pressure lower than that P1 of the hydraulic fluid which fills the second working chamber C2. the same receiving this fluid at the pressure P1 through a conduit (FIG. 1) connected to a not shown hydraulic source.

The valve 5 comprises a sleeve 11 coaxial with the plug 4, and is connected on the one hand directly to the hydraulic pressure $P_1$, and on the other hand, through two diametrically opposite apertures, to a hydraulic fluid tank T by means of two conduits at a low pressure $P_0$.

This servo-control system includes a feedback device for "recopying position" after an order from the pilot has brought about a rotation of the plug 4 through the given angle and the consequential pivoting of flap 1. This recopying device known per se and not shown, automatically returns the sleeve 11 to its initial angular position with respect to the plug 4, so as to stabilize the flap 1 in its new position.

The fluid under pressure P1 enters the valve 5 by two diametrically opposed apertures, as well as the fluid under pressure Po and the fluid circulating in conduit A.

The hydraulic valve according to the invention will be now described in detail in reference to FIGS. 2 to 8.

This hydraulic directional valve 35 comprises a central plug 12 rotatively mounted in a fixed liner 13 coaxial with plug 12, and an annular sleeve 14 which is also coaxial with plug 12 and interposed between the latter and the liner 13. Liner 13 is fixed to a body 15 with interposition of a tubular sealing element 16.

The assembly of these elements is disposed in the body 15 from which the plug 12 projects as an end part 17 fixed to a transverse arm 18 controlling the rotation of the plug 12. Diametrically opposed ports 19, 21, 22 which are therefore six in number, are provided angularly equally spaced apart in the tubular sealing element 16. In alignment with these ports 19, 21, 22, other ports 23, 24, 25 also six in number, are provided in the liner 13 (FIGS. 2, 3, 4, 5, 6). Two ports 23 are diametrically opposed, as well as the two ports 24 and the two ports 25. The two ports 24 extend axially on a part of the length of the liner 13, so as to establish a communication between ports 22 and two diametrically opposed ports 28 provided in the sleeve 14.

The two ports 23 extend axially in the opposite direction with respect to ports 24 and on a part of the length of liner 13, so as to connect ports 19 to two diametrically opposed ports 26 provided in the sleeve 14. At last, the two ports 25 extend axially on the whole length of liner 13, in order to establish a communication between two diametrically opposed ports 27 provided in the sleeve 14 and the two corresponding ports 21 of element 16. Ports 21 communicate either with an outlet 31 formed in the body 15 for discharging the fluid from the valve and which is at the pressure Po.

The two ports 19 are connected to the conduit A, and the two ports 22 receive the fluid under pressure $P_1$ (as shown on FIG. 1) by means of a conduit 30 (FIGS. 2, 3) formed in the body 15. The arrangement of ports 23, 25 with respect to the other already mentioned ports is also clearly shown on FIGS. 4 and 5.

Two peripheral and diametrically opposed cavities *29a, 29b* are formed on the plug 12 in regard to ports 26, and can communicate with ports 28 or with ports 27 according to the angular position of plug 12.

Figure 3:
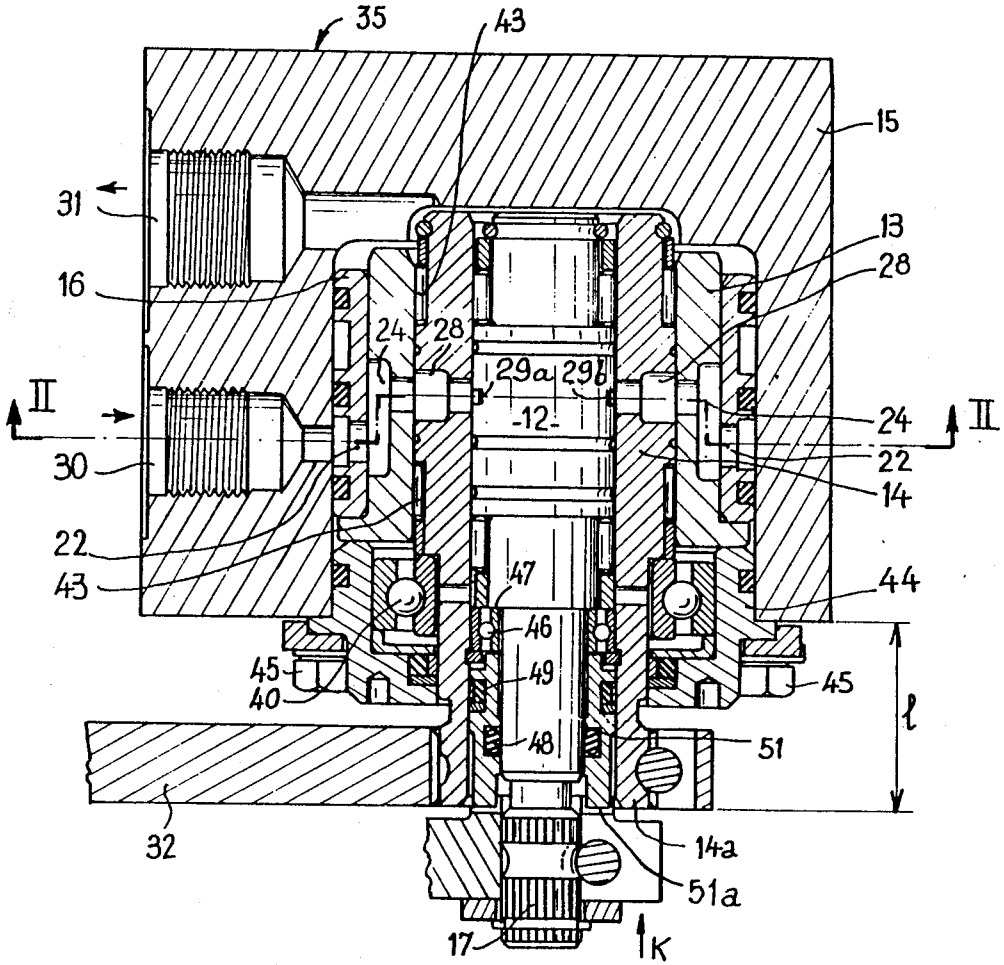
FIG. 3 is an axial sectional view of the hydraulic valve taken along line III of FIG. 2.
Figure 7:
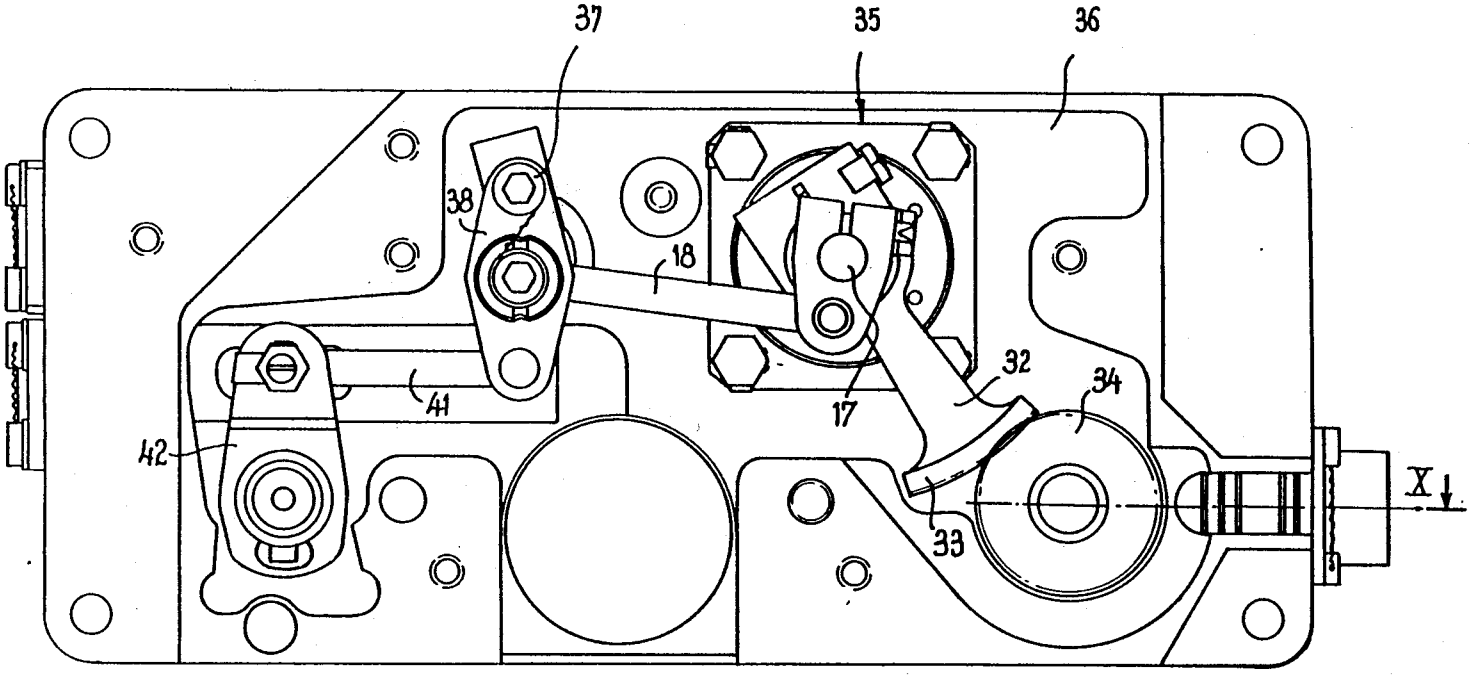
FIG. 7 is a top plan view, in the direction of arrow K of FIG. 3, of the valve of the invention.
Figure 8:
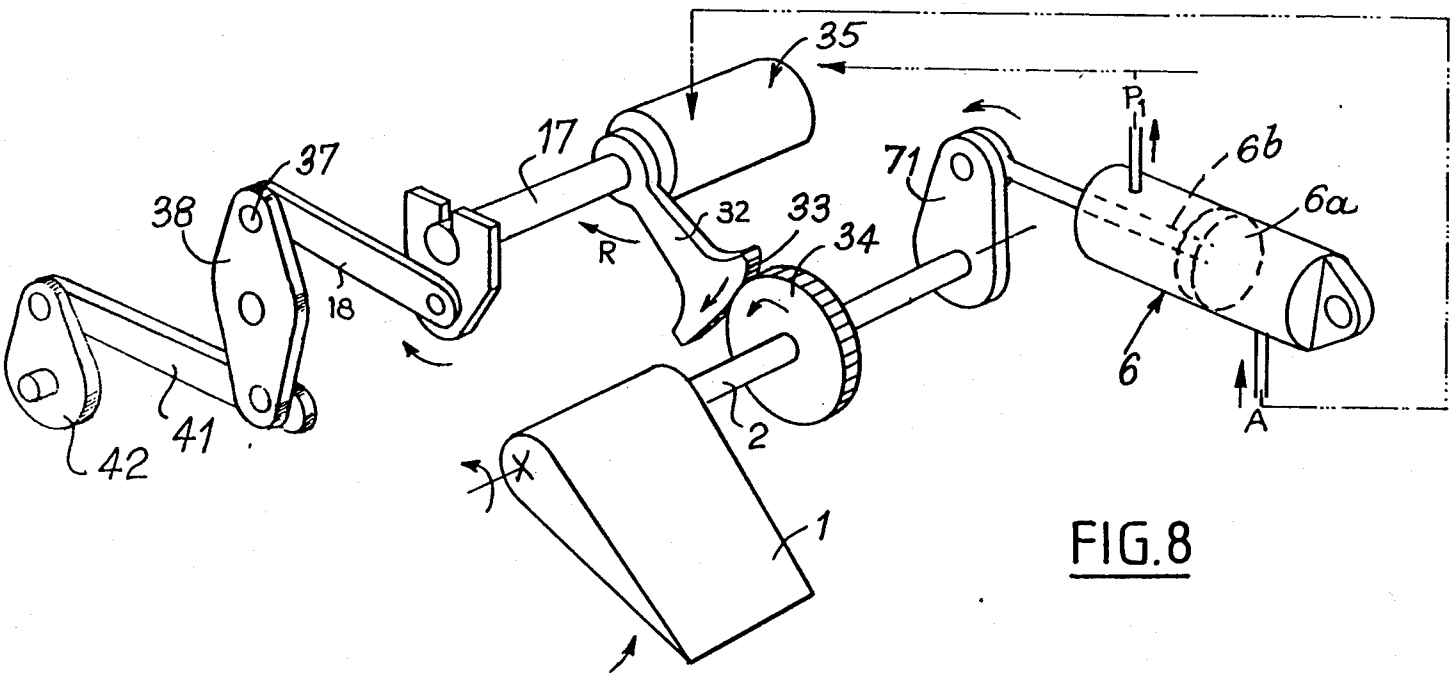
FIG. 8 is a perspective view of the servo-control device incorporating a valve according to the invention.
Figures 9, 10:
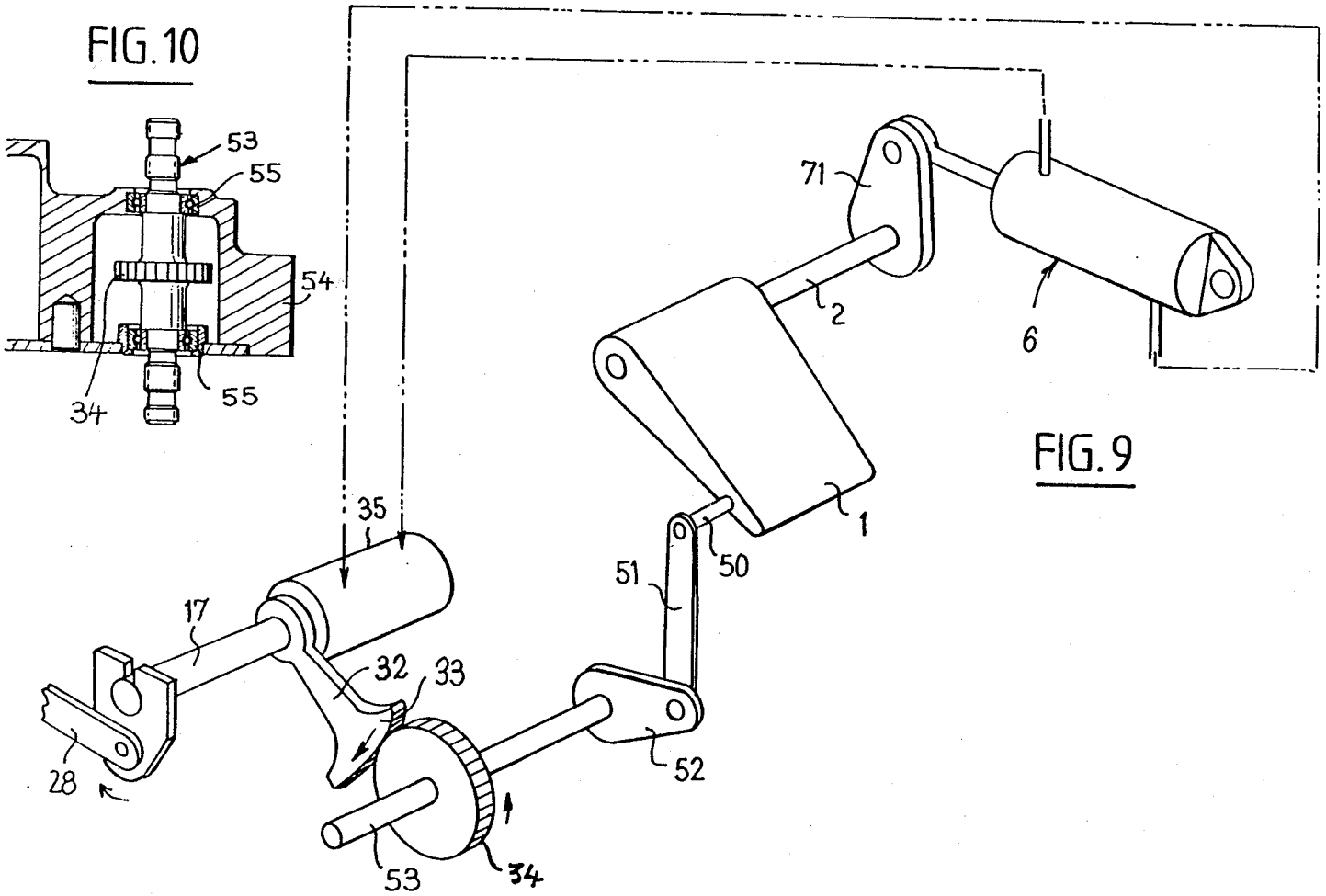
FIG. 9 is a perspective view of the servo-control device incorporating a valve according to an alternative embodiment of the invention in which like elements to that of FIG. 8 are identically numbered.
FIG. 10 is a sectional view showing the gear wheel mounted for rotation about its axis via a shaft mounted for rotation to opposite sides of the gear wheel through ball bearings.

The rotary sleeve 14 projects to a given extent 1 outside the body 15 on the same side as the plug 12, and its outer projecting portion *14a* is connected to rotate with a lateral lever 32 (FIGS. 3, 7 and 8).

The lever 32 has a toothed end sector 33 engaged with a gear wheel 34 coaxial with axis 2 which freely passes through wheel 34. The latter can be rotated by other (not shown) means of the recopying position device. The axel 2 is attached to a lever 71 on which the piston rod *6b* is articulated.

The valve 35 is fixed on a support 36 carrying a pin 37 on which is pivotally mounted a lever 38 on which is pivotally mounted the arm 18 controlling the rotation of the plug 12. Also pivotally mounted on the lever 38 is an arm 41 which can be driven in translation by a driving means 42. All these various elements may be disposed on the same side of the support 36.

Figure 6:
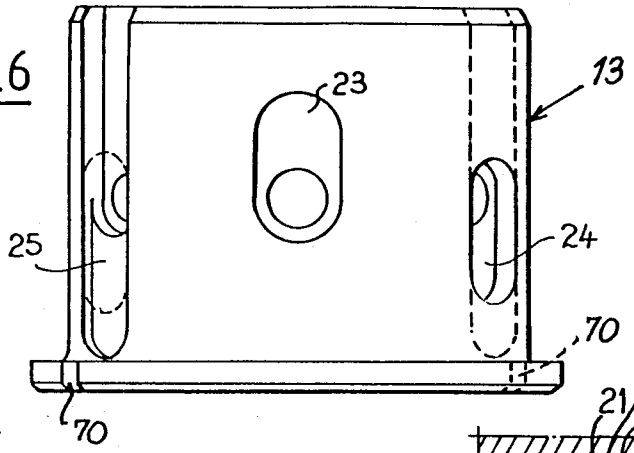
FIG. 6 is an elevational view of the liner of the valve.
Figure 4:
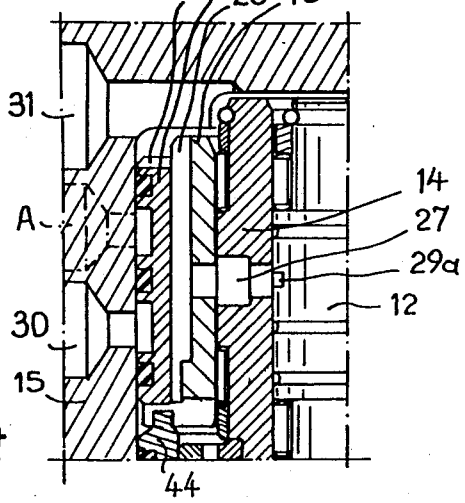
FIG. 4 is a partial axial sectional view of the hydraulic valve taken along line IV of FIG. 2.
Figure 5:
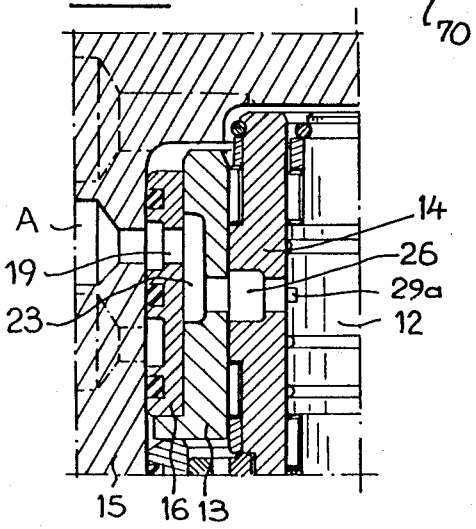
FIG. 5 is a partial axial sectional view of the hydraulic valve taken along line V of FIG. 2.

With reference to FIG. 3, the rotary sleeve 14 is shown to be mounted on a ball bearing 40 and on needle bearings 43, the latter being interposed between the sleeve 14 and the liner 13. The bearing 40 is interposed between the sleeve 14 and a tubular element 44 fixed to the body 15 by bolts 45. The liner 13 and element 44 are fixed together by means of screws not shown which pass through threaded bores 70 of liner 13 (FIG. 6). Another ball bearing 46 is interposed between the sleeve 14, the plug 12 and an annular shoulder 47 on the latter.

Annular sealing elements 48, 49 inserted in a tubular element 51 interposed between the projecting portion *14a* of the sleeve 14 and the plug 12, ensure a seal between the projecting portion *14a*, the interposed element 51 and the plug 12. This tubular element 51 is connected to rotate with the plug 12 and the arm 18 by complementary teeth or finger members *51a*. By way of a modification, the element 51 could be connected to rotate with the sleeve 14.

Figure 2:
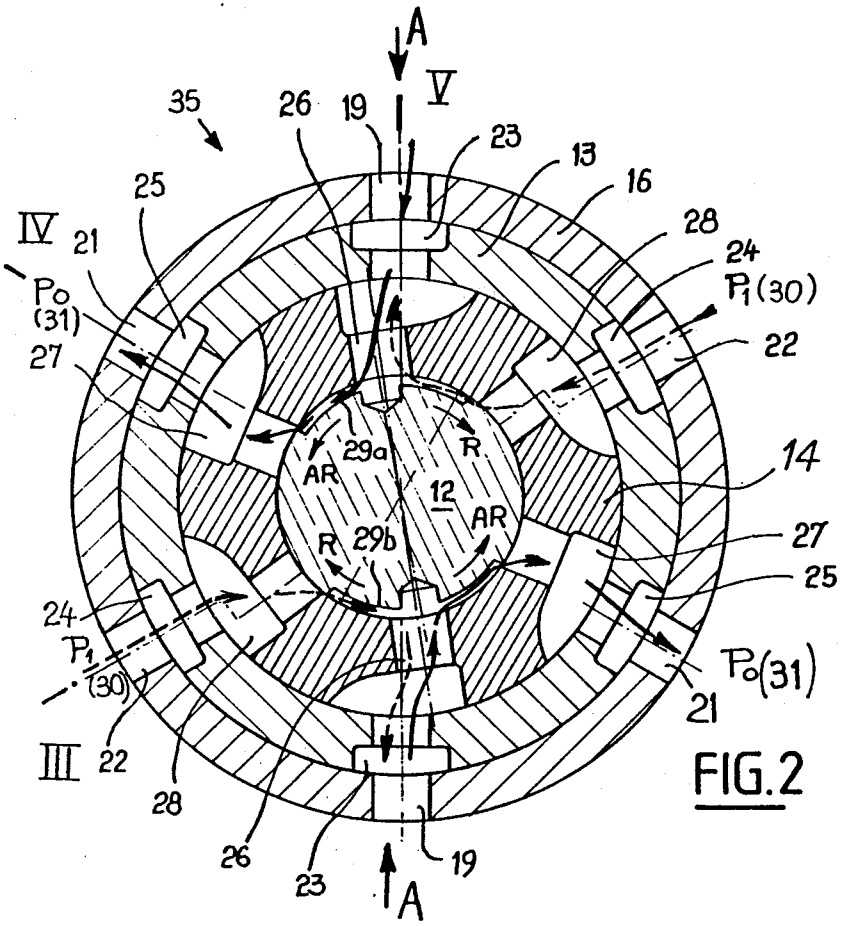
FIG. 2 is a cross-sectional view of an embodiment of the hydraulic directional valve according to the invention, taken along line II—II of FIG. 3.

The device above described operates in the following manner:

In the position shown in FIG. 2, the plug 12 is oriented in such manner as to stop the fluid in the two diametrically opposed cavities *29a, 29b* and the extent of which corresponds to equal angular sectors. In this position indeed, it can be seen that the fluid cannot flow between, on the one hand ports 19, 23, 26, and on the other hand, ports 28, 24, 22.

(1) If the pilot of the aircraft actuates the valve 35 through the control elements 42, 41, 38, 18, 17 in such manner as to rotate the plug 12 in the clockwise direction R (arrows on FIGS. 2 and 8), the fluid under high pressure P1 flows into the valve 35 through the conduit 30, ports 22, 24, 28, 29a and *29b*, and from there flows through ports 26, 23, 19 into the conduit A and the chamber C1 (see arrows on FIG. 2). Due to the presence of the rod *6b* in the chamber C2, the force exerted on the fluid at the P1 pressure in chamber $C_1$ on the opposite face of the piston *6a* is higher than the force exerted by the fluid at the pressure $P_1$ in the chamber C2. Consequently, the piston *6a* and the rod *6b* move toward the left on FIG. 8 (towards the right on FIG. 1), so that the lever 71 rotates together with axis 2 which rotates the spoiler 1 upwards.

The path of the fluid is shown by interrupted arrows on FIG. 2 and the senses of rotation of elements 71, 2, 1 are shown by continuous arrows on FIG. 8.

Consequently, the flap or spoiler 1 of the aircraft is pivoted through an angle which increases so long as the order for rotating the plug 12 is maintained, and the fluid can flow through the ports 22 to the ports 19. Further, as soon as these ports are put into communication with each other, the position copying device, which incorporates the gear wheel 34 proceeds to rotate the latter in the direction which pivots the lever 32 and consequently the sleeve 14, so that the latter rotates in the same direction as the plug 12, the movement of which is thus "followed" with a certain time lag.

This angular displacement of the sleeve 14 continues until the same has resumed its initial angular position with respect to the plug 12. At this moment, the communication between the ports 22 and 19 is interrupted, the rotation of the sleeve 14 stops, and the flap 1 of the aircraft remains in its new position resulting from the command of the pilot.

(2) If now the pilot orders the lever 42 in the direction opposite to the preceding, the plug 12 is actuated in rotation in the counterclockwise direction AR (FIG. 2). The fluid can now flow from ports 19, 23, 26, 29a; 29b into ports 27, 25, 21 and the outlet 31 at the pressure Po this path being illustrated by full arrows on FIG. 2. The fluid at low pressure Po flows to the tank T, whilst no fluid can flow between ports 22 and 19.

Consequently, the pressure of the fluid in the chamber C2 becomes notably higher than the pressure in the chamber C1 and the piston 6a moves on the right (FIG. 8), so that the pivot axis 2 drives the flap 1 downwards in rotation.

As before, the sleeve 14 rotated by its lever 32 and the gear wheel 34 of the recopying position device or feedback device, copies the angular position of the plug 12, its angular displacement automatically stopping when the communication between the ports 19 and 21 is interrupted.

The scope of the invention is not intended to be limited to the described embodiment which receives modifications. In any case, the fact of ensuring the copying of the angular position of the plug 12 by connecting the sleeve 14 with a lever such as 32 of the feedback device, considerably reduces the overall size and the complexity of the device which would be necessary if a conventional arrangement had been adopted.

In order to achieve this advantageous result, it is indeed sufficient to provide a rotatively mounted sleeve 14 having a projecting portion 14a outside the body 15, so as to enable it to be driven by a suitable element, such as 32, rolling bearings and suitably arranged sealing means being provided between, on one hand, the sleeve 14 and the body 15 and, on the other hand, between the plug 12 and the sleeve 14.

What is claimed:

1. A hydraulic directional valve for a bidirectional aircraft servo-control operatively coupled to flaps of an aircraft, said valve comprising a body, a liner (13) fixed in the body, a plug rotatively mounted in the liner and having an end portion which projects from a side of the body, a control device connected to the end portion of the plug, an annular sleeve (14) interposed between the plug (12) and the liner, ports for the inlet of a hydraulic fluid provided in the liner and in the sleeve, passages (29a, 29b) provided on a peripheral portion of the plug (12) for ensuring the circulation of the hydraulic fluid from one port to the other of the liner (13) by passing through the ports of the sleeve when the plug rotates, the sleeve (14) being rotatively mounted in the body and having an end portion which projects from the side of the body (15) from which side projects said end portion of the plug, a feedback device (34), and a lateral lever (32) connected to the end portion of the sleeve (14), defining position copying means and associated with the feedback device (34), the feedback device being capable of progressively returning the sleeve (14), through said lever (32), to an initial angular position with respect to the plug (12), after rotation of the plug through a predetermined angle, such that said flaps remain in adjusted position through said feedback device after termination of plug rotation to effect such adjustment of the flaps with the position copying means being highly compact and of simplified construction.

2. A valve according to claim 1, comprising, in a region of said end portion (17) of the plug (12) and said end portion (14a) of the sleeve (14), an interposed element (51) which is connected to rotate with one of two elements consisting of the plug (12) and sleeve (14) and is provided with sealing means (48, 49) respectively cooperating with the plug and sleeve.

3. A servo-control device for an aircraft comprising a support (36), a directional valve (35) fixed on the support and comprising a body, a liner fixed in the body, a plug rotatively mounted in the liner and having an end portion which projects from a side of the body, a control device connected to the end portion of the plug, an annular sleeve interposed between the plug and the liner, ports for the inlet of a hydraulic fluid under pressure and the outlet of the hydraulic fluid provided in the liner and in the sleeve, passages provided on a peripheral portion of the plug for ensuring the circulation of the hydraulic fluid from one port to the other of the liner by passing through the ports of the sleeve when the plug rotates, the sleeve being rotatively mounted in the body and having an end portion which projects from the side of the body from which side projects said end portion of the plug, a feedback device, and a lateral lever connected to the end portion of the sleeve and associated with the feedback device, the feedback device being capable of progressively returning the sleeve, through said lever, to an initial angular position with respect to the plug, after rotation of the plug through a predetermined angle, said control device comprising an arm (18) fixed to said end portion of the plug (12), a second lever (38) pivotally mounted on the support (36) and pivotally connected to the arm (18), a member (41) pivotally connected to the second lever (38), and driving means connected to the member (41), the lateral lever (32) connected to the said end portion of the sleeve (14) carrying a toothed sector (33) at an end of the lateral lever remote from the sleeve, the feedback device having a toothed element (34) which is engaged with the toothed sector (33).

* * * * *